United States Patent [19]

O'Brien et al.

[11] 4,268,406

[45] May 19, 1981

[54] LIQUID DETERGENT COMPOSITION

[75] Inventors: Thomas P. O'Brien, Loveland; Lawrence Benjamin, Cincinnati, both of Ohio

[73] Assignee: The Procter & Gamble Company, Cincinnati, Ohio

[21] Appl. No.: 122,143

[22] Filed: Feb. 19, 1980

[51] Int. Cl.[3] ..... C11D 7/56; C11D 7/54

[52] U.S. Cl. ..... 252/105; 256/525; 256/544; 256/DIG. 14

[58] Field of Search ..... 252/105, 544, 525, DIG. 14

[56] References Cited

U.S. PATENT DOCUMENTS

| | | | |
|---|---|---|---|
| 3,149,042 | 9/1964 | Habicht et al. | 252/105 X |
| 3,700,601 | 10/1972 | Bloching | 252/105 |
| 3,751,222 | 8/1973 | Gobert | 252/105 |
| 4,001,132 | 1/1977 | Maguire, Jr. | 252/105 |

FOREIGN PATENT DOCUMENTS

| | | | |
|---|---|---|---|
| 48-01085 | 1/1973 | Japan | 252/105 |

*Primary Examiner*—Mayer Weinblatt

*Attorney, Agent, or Firm*—Edmund F. Gebhardt; Richard C. Witte; Thomas H. O'Flaherty

[57] ABSTRACT

Liquid dishwashing detergent compositions exhibiting superior cleaning of protein and carbohydrate soils comprise an anionic surfactant, an amide, a reducing agent, a protein denaturant and water.

7 Claims, No Drawings

LIQUID DETERGENT COMPOSITION

TECHNICAL FIELD AND BACKGROUND ART

The invention relates to aqueous high sudsing liquid detergent compositions containing specified amounts and types of ingredients especially useful in the washing of tableware and kitchenware.

The compositions of this invention provide cleaning benefits not heretofore obtained with liquid detergent compositions suitable for a hand dishwashing process involving soaking tableware and kitchenware in dilute solutions of the compositions followed by rinsing and draining.

A number of different types of soils are encountered in dishwashing. In general, the detergent compositions developed for use in a hand dishwashing process have a surfactant content that provides for removal of natural fats and oils from tableware and kitchenware. Mildness to skin and a level of suds to indicate cleaning potential are other factors usually considered. Less attention has been given to removal of soils encountered in hand dishwashing other than fats and oils. In particular, there is a continuing need for detergent compositions that provide for faster and more complete removal of protein and carbohydrate soils during a hand dishwashing process. Ideally, such compositions will involve a compatible combination of materials which will simultaneously provide the sudsing, mildness and aesthetic attributes of an acceptable dishwashing detergent composition as well as an improved ability to remove protein and carbohydrate-based soils.

It is an object of the present invention to provide liquid detergent compositions suitable for hand dishwashing and a process for hand dishwashing that have an improved ability to remove protein and carbohydrate-based soils.

The compositions of the present invention contain a reducing agent and a nitrogen-containing protein denaturant as hereinafter specified. Detergent compositions containing reducing agents and the operative protein denaturants have been disclosed, but it has not been recognized that their combination in specific liquid detergent compositions suitable for hand dishwashing would provide a substantial advantage of protein and carbohydrate soil removal in a hand dishwashing process.

U.S. Pat. No. 4,001,132 discloses granular automatic dishwasher detergent compositions containing 15–60% of a mixture of water-soluble sulfites and sulfates in a 1:4 to 2:1 weight ratio.

U.S. Pat. No. 3,149,042 discloses liquid hair care preparations containing a reducing agent and a diamine compound such as urea, thiourea or biuret.

U.S. Pat. No. 3,700,601 discloses liquid detergent compositions containing 5–40% of anionic or nonionic surfactants, 0.1–5% of a chlorinated diphenyl ether disinfectant and 0.01–5% by weight of the surfactant and disinfectant of a water-soluble reducing agent.

Soviet Union Pat. No. 479,804 (Volskaya SA) discloses a detergent composition containing surfactants, sodium silicate, sodium tripolyphosphate, urea, capronamide and 3–6% ammonium bisulfate. The composition is said to be a homogeneous mass providing a pH of 7–9 (1% solution at 20° C.).

SUMMARY OF THE INVENTION

The present invention encompasses liquid detergent compositions comprising:

(a) from about 15% to about 50% by weight of an anionic surfactant (b) from about 2.5% to about 10% of an amide having the general formula $$R_1—CO—N(H)_m(R_2OH)_{2-m}$$

wherein $R_1$ is an aliphatic hydrocarbon radical having from about 7 to about 21 carbon atoms, $R_2$ is an aliphatic hydrocarbon radical having from 1 to 3 carbon atoms and m is zero, 1 or 2, (c) from about 2% to about 25% of a reducing agent selected from the group consisting of water-soluble salts of reductive sulfur oxygen acids, salts of reductive acids of phosphorus, inorganic reductive nitrogen compounds, stannites and mixtures thereof, (d) from about 2% to about 20% of a protein denaturant selected from the group consisting of urea, guanidine and its salts, thiourea, biuret, thiobiuret and the water soluble alkyl, alkylol and acyl derivatives of these compounds, ammonia, alkanolamines, and mixtures thereof, and (e) from about 20% to about 88.5% water, said detergent composition providing a pH of at least 9.5 in a 0.4% solution in water at 20° C.

In the process or method aspect of the invention, dishware, glassware, and other tableware and kitchenware are washed in water solutions of the detergent composition, generally at a weight concentration of about 0.05% to about 0.5% of the composition in water at a temperature of about 80° F. to about 120° F. The tableware and kitchenware is then rinsed and drained.

DETAILED DESCRIPTION OF THE INVENTION

This invention relates to the liquid detergent compositions that provide superior removal of protein and carbohydrate-based soils in a hand dishwashing process.

While not intending to be limited by theory, it is believed that the combination of the reducing agent, the protein denaturant as hereinafter described and a solution pH above about 9.5 provide, in combination, the conditions necessary to denaturize or otherwise degrade water-insoluble protein into single chain water soluble protein derivatives, peptides or other simpler structures. In particular, it is believed that the combination of ingredients begins the denaturation of protein by the breaking of disulfide cross-linkages in the protein polymer. This allows subsequent and additional degradation via breakage of other structural stabilizing bonds such as hydrogen or hydrophobic bonds.

The compositions of the present invention comprise five essential components: an anionic surfactant, an amide, a reducing agent, a nucleophilic protein denaturant and water, all as hereinafter defined. Optional ingredients can be added to provide various performance, aesthetic and product stability characteristics.

Anionic Surfactant

The compositions of this invention contain from about 15% to about 50% by weight of an anionic surfactant or mixtures thereof. Preferred compositions contain from about 20% to about 35% of anionic surfactant by weight.

Most anionic detergents can be broadly described as the water-soluble salts, particularly the alkali metal, alkaline earth metal, ammonium and amine salts, of organic sulfuric reaction products having in their molecular structure an alkyl radical containing from about 8 to about 22 carbon atoms and a radical selected from the group consisting of sulfonic acid and sulfuric acid ester radicals. Included in the term alkyl is the alkyl portion of acyl radicals. Examples of the anionic synthetic detergents which can form the surfactant component of the compositions of the present invention are the sodium, ammonium, potassium or magnesium alkyl sulfates, especially those obtained by sulfating the higher alcohols ($C_8$–$C_{18}$ carbon atoms); sodium or magnesium alkyl benzene or alkyl toluene sulfonates, in which the alkyl group contains from about 9 to about 15 carbon atoms, the alkyl radical being either a straight or branched aliphatic chain; sodium or magnesium paraffin sulfonates and olefin sulfonates in which the alkyl or alkenyl group contains from about 10 to about 20 carbon atoms; sodium $C_{10-20}$ alkyl glyceryl ether sulfonates, especially those ethers of alcohols derived from tallow and coconut oil; sodium coconut oil fatty acid monoglyceride sulfates and sulfonates; sodium, ammonium or magnesium salts of alkyl phenol ethylene oxide ether sulfates with about 1 to about 30 units of ethylene oxide per molecule and in which the alkyl radicals contain from 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium beta-acetoxy- or beta-acetamido-alkanesulfonates where the alkane has from 8 to 22 carbon atoms.

Specific examples of alkyl sulfate salts which can be employed in the instant detergent compositions include sodium lauryl alkyl sulfate, sodium palmityl alkyl sulfate, sodium decyl sulfate, sodium myristyl alkyl sulfate, potassium lauryl alkyl sulfate, potassium decyl sulfate, potassium palmityl alkyl sulfate, potassium myristyl alkyl sulfate, sodium dodecyl sulfate, magnesium dodecyl sulfate, sodium coconut alkyl sulfate, potassium coconut alkyl sulfate, magnesium $C_{12-15}$ alkyl sulfate and mixtures of these surfactants. Preferred alkyl sulfates include sodium $C_{12-15}$ alkyl sulfate and magnesium $C_{12-15}$ alkyl sulfate.

Suitable alkylbenzene or alkyltoluene sulfonates include the alkali metal (lithium, sodium, potassium), alkaline earth (calcium, magnesium) ammonium and alkanolamine salts of straight- or branched-chain alkylbenzene or alkyltoluene sulfonic acids. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids as precursors of the alkyl-benzene sulfonates useful for compositions herein are those in which the alkyl chain is linear and averages about 11 to 13 carbon atoms in length. Examples of commercially available alkyl benzene sulfonic acids useful in the present invention include Conoco SA 515 and SA 597 marketed by the Continental Oil Company and Calsoft LAS 99 marketed by the Pilot Chemical Company.

Particularly preferred anionic surfactants useful herein are alkyl ether sulfates having the formula $RO(C_2H_4O)_xSO_3M$ wherein R is alkyl or alkenyl of about 10 to about 20 carbon atoms, x is 1 to 30, and M is a water-soluble cation. The alkyl ether sulfates useful in the present invention are condensation products of ethylene oxide and monohydric alcohols having from about 10 to about 20 carbon atoms. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Specific examples of alkyl ether sulfates of the present invention are sodium coconut alkyl triethylene glycol ether sulfate, magnesium $C_{12-15}$ alkyl triethylene glycol ether sulfate, and sodium tallow alkyl hexaoxy ethylene sulfate. Preferred alkyl ether sulfates are those comprising a mixture of individual compounds, said mixture having an average alkyl chain length of from about 12 to 16 carbon atoms and an average degree of ethoxylation of from about 1 to 12 moles of ethylene oxide.

Additional examples of anionic surfactants useful herein are the compounds which contain two anionic functional groups. These are referred to as di-anionic surfactants. Suitable dianionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium 1,2-alkyldisulfonates or disulfates, disodium, 1,9-hexadecyl disulfates, $C_{15}$ to $C_{20}$ disodium 1,2-alkyldisulfonates, disodium, 1,9-stearyldisulfates and 6,10-octadecyldisulfates.

Amide

The compositions of this invention contain from about 2.5% to about 10% of an amide of a fatty acid. Preferred compositions contain from about 3.5% to about 7% amide.

The amides suitable for use in the compositions of the invention provide a stabilization of suds necessary to performance and acceptability of a hand dishwashing product. The amide also assists in the cleaning function. The amides of the invention have the general formula: $R_1—CO—N(H)_m(R_2OH)_{2-m}$ wherein $R_1$ is an aliphatic hydrocarbon radical having from about 7 to about 21 carbon atoms, $R_2$ is an aliphatic hydrocarbon radical having 1 to 3 carbon atoms and m is zero, 1 or 2.

Preferred amides are the monoethanol amides of $C_{10-16}$ fatty acids. Diethanol amides are less suitable and the semi-polar amine oxide nonionic surfactants used as suds stabilizers in conventional liquid dishwashing detergent compositions have not proven adequately stable in the compositions of the present invention.

Reducing Agent

The compositions of this invention contain from about 2% to about 25%, preferably from about 4% to about 20%, and most preferably from about 5% to about 15% of a reducing agent selected from the group consisting of water soluble salts of reductive sulfur oxygen acids, salts of reductive acids of phosphorus, inorganic reductive nitrogen compounds and mixtures thereof. Preferred reducing agents are the alkali metal, alkaline earth metal, ammonium or substituted ammonium salts of sulfites, bisulfites, thiosulfates and metabisulfites.

Examples of phosphorus-containing reducing agents are the salts of phosphorus acid and sodium hypophosphite. Inorganic reductive nitrogen compounds include salts of hydrazine or hydroxylamine. An example of a stannite is sodium stannite.

The reducing agents of the invention have at least limited water solubility, but are not necessarily completely in solution in the compositions of the invention.

Surprisingly, the compositions of the invention do not have odor problems typical of many compositions containing reducing agents.

Protein Denaturant

The compositions of this invention comprise from about 2% to about 20%, preferably from about 3% to about 10%, by weight of a nitrogen-containing protein denaturant. A characteristic feature of many of the operable protein denaturants is an unshared pair of electrons and a resultant designation as a nucleophilic reagent. Operative protein denaturants include urea, guanidine and its salts, thiourea, biuret, thiobiuret and the water-soluble alkyl, alkylol and acyl derivatives of these compounds, ammonia (or ammonium ion to the extent it exists in the alkaline compositions of the present invention), and the alkanolamines, particularly monoethanolamine and triethanolamine, in free form or in combined or ionic form, for example, as the cations of anionic surfactants.

Particularly preferred protein denaturants are urea, ammonia, monoethanolamine and mixtures thereof.

Water

The compositions of the invention contain from about 20% to about 88.5% water. Preferred compositions contain from about 25% to about 60% water.

The compositions of the invention contain sufficient water-soluble alkaline materials to provide a pH in a 0.4% water solution of at least about 9.5, preferably from about 9.7 to about 10.5, measured at 20° C.

In preferred compositions there is a reverse alkalinity equivalent to at least about 1 gram of sodium hydroxide per 100 milliliters of the detergent composition. Reserve alkalinity is measured by titration of a 10% solution of the composition in water with dilute hydrochloric to a pH of 9.5. The weight equivalent of sodium hydroxide to the acid used to reach pH 9.5 is defined as reserve alkalinity.

Optional Surfactants

The compositions of the invention can contain other optional surfactants such as nonionic, ampholytic, zwitterionic and cationic surfactants.

Suitable nonionic surfactants include:

1. The polyethylene oxide condensates of alkyl phenols. These compounds include the condensation products of alkyl phenols having an alkyl group containing from about 8 to about 15 carbon atoms, in either a straight chain or branched chain configuration, with ethylene oxide, the ethylene oxide being present in amounts equal to from about 3 to about 9 moles of ethylene oxide per mole of alkyl phenol. The alkyl substituent in such compounds may be derived, for example, from polymerized propylene or isobutylene, or from octene or nonene. Examples of compounds of this type include nonyl phenol condensed with about 9 moles of ethylene oxide per mole of nonyl phenol and dodecyl phenol condensed with about 8 moles of ethylene oxide per mole of dodecyl phenol. Commercially available nonionic surfactants of this type include Igepal CO-610, CA-420, CA-520 and CA-620, marketed by the GAF Corporation, and Triton X-45, X-114, X-100 and X-102, marketed by the Rohm and Haas Company.

2. The condensation products of aliphatic alcohols with ethylene oxide. The alkyl chain of the aliphatic alcohol may either be straight or branched and contains from about 8 to about 18 carbon atoms. Examples of such ethoxylated alcohols include the condensation product of about 5 moles of ethylene oxide with 1 mole of tridecanol, myristyl alcohol condensed with about 8 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with coconut alcohol. Examples of commercially available nonionic surfactants of this type include Tergitol 15-S-7 marketed by the Union Carbide Corporation and Neodol 23-6.5 marketed by the Shell Chemical Company. Whether the alcohol is derived from natural fats or produced by one of several petrochemical processes, a mixture of carbon chain lengths is typical. The stated degree of ethoxylation is an average, the spread being dependent on process conditions, including choice of catalyst.

Ethoxylated alcohols are preferred because of their superior biodegradability relative to ethoxylated alkyl phenols. Particularly preferred are ethoxylated alcohols having an average of from about 10 to about 14 carbon atoms in the alcohol and an average degree of ethoxylation of from about 4 to about 6 moles of ethylene oxide per mole of alcohol.

Ampholytic surfactants can be broadly described as derivatives of aliphatic amines which contain a long chain of from about 8 to about 18 carbon atoms and an anionic water-solubilizing group, e.g. carboxy, sulfonate or sulfate. Examples of compounds falling within this definition are sodium-3-dodecylamino propane sulfonate, and dodecyl dimethylammonium hexanoate.

Zwitterionic surface active agents operate in the instant composition are broadly described as internally-neutralized derivatives of aliphatic quanternary ammonium and phosphonium and tertiary sulfonium compounds in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono.

Cationic surfactants such as quaternary ammonium compounds can find optional use in the practice of the invention to the extent they are compatible with the other surfactants in the particular composition.

Other Optional Components

The detergent compositions herein optionally, but preferably, also contain detergent builder materials. A preferred range of detergency builder materials is from about 5% to about 25% by weight. Detergency builders are generally characterized by an ability to sequester or precipitate water hardness ions, particularly calcium and magnesium. They may also be used to maintain or assist in maintaining the necessary alkaline pH of the washing solution.

All manner of detergency builders commonly taught for use in detergent compositions are suitable for use herein. Useful binders include any of the conventional inorganic and organic water-soluble builder salts.

Such detergency builders can be, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium pyrophosphates, tripolyphosphates, orthophosphates, and metaphosphates. The polyphosphonates specifically include, for example, the salts of ethylene diphosphonic acid, the salts of ethane 1-hydroxy-1,1-diphosphonic acid and the salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference.

Non-phosphorus containing sequestrants can also be selected for use herein as detergency builder.

Specific examples of non-phosphorus, inorganic builder ingredients include water-soluble inorganic carbonate, bicarbonate, and silicate salts. The alkali metal, e.g., sodium and potassium, carbonates and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Other suitable polycarboxylates for use herein are the polyacetal carboxylates fully described in U.S. Pat. No. 4,144,226, issued Mar. 13, 1979 to Crutchfield, et al., and U.S. Pat. No. 4,146,495, issued Mar. 27, 1979 to Crutchfield, et al., the disclosures of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Preferred non-phosphorus builder materials herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other preferred builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid and methylenemalonic acid.

Additional, preferred builders herein include the water-soluble salts of carboxymethyloxymalonate, carboxymethyloxysuccinate, cis-cyclohexanehexacarboxylate, cis-cyclopentanetetracarboxylate phloroglucinol trisulfonate, and the copolymer of maleic anhydride with vinyl methyl ether or ethylene.

A further class of detergency builder materials useful in the present invention are insoluble sodium aluminosilicates, particularly those disclosed in Belgian Pat. No. 814,874 issued Nov. 12, 1974 and incorporated herein by reference. This patent discloses detergent compositions containing sodium aluminosilicates of the formula $$Na_z(AlO_2)_z(SiO_2)_y xH_2O$$

wherein z and y are integers of at least 6, the molar ratio of z to y is in the range from 1.0:1 to about 0.5:1 and x is an integer from about 15 to about 264, said aluminosilicates having a calcium ion exchange capacity of at least 200 mg. eq./gm. and a calcium ion exchange rate of at least about 2 grains/gallon/minute/gram. A preferred material is $Na_{12}(SiO_2.AlO_2)_{12}.27H_2O$. Aluminosilicates for use herein include the amorphous and crystalline aluminosilicates disclosed in the pending U.S. patent application of Rodriguez, et al., Ser. No. 049,704, filed June 18, 1979, incorporated herein by reference. Particularly useful aluminosilicates are those commonly known as Zeolites A, X, and P(B).

Alcohols, such as ethyl alcohol, and hydrotropes, such as sodium and potassium toluene sulfonate, sodium and potassium xylene sulfonate, trisodium sulfosuccinate and related compounds (as disclosed in U.S. Pat. No. 3,915,903, incorporated herein by reference) can be utilized in the interests of achieving a desired product phase stability and viscosity. Ethyl alcohol at a level of from about 3% to about 15% and potassium or sodium toluene, xylene or cumene sulfonate at a level of from about 1% to about 6% are particularly useful in the compositions of the invention.

The detergent compositions of this invention can contain, if desired, any of the usual adjuvants, diluents and additives, for example, perfumes, enzymes, dyes, antitarnishing agents, antimicrobial agents, and the like, without detracting from the advantageous properties of the compositions. Alkalinity sources and pH buffering agents such as alkali metal hydroxides can also be utilized.

As noted hereinbefore, the compositions of the invention can contain materials which are insoluble or not completely soluble at the levels employed in a particular composition.

Particularly useful in such compositions are suspending or thickening agents such as those disclosed in U.S. Pat. No. 3,393,153 incorporated herein by reference including colloidal silica having a mean particle diameter ranging from about 0.01 micron to about 0.05 micron, colloidal clays such as bentonites or chemically treated bentonites, isomorphous silicates, especially those with a high magnesium content, particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples of suspending and thickening agents include copolymers of styrene with monomers such as maleic anhydride, nitrilonitrile, methacrylic acid and lower alkyl esters of methacrylic acid, copolymers of styrene with methyl or ethyl acrylate, methyl or ethyl maleate, vinyl acetate, acrylic maleic or fumaric acids and mixtures thereof. The mole ratio of ester and/or acid to styrene is preferably in the range from about 4 to about 40 styrene units per ester and/or acid unit. Such materials preferably have a mean particle diameter range of from about 0.05 micron to about 1 micron and molecular weights ranging from about 500,000 to about 2,000,000. Cellulosic polymers such as carboxymethyl cellulose and hydroxypropyl cellulose and gums such as guar gum and gum tragacanth are also suitable suspending and thickening agents.

The following non-limiting examples illustrate the detergent compositions of the present invention. All percentages, parts or ratios used herein are by weight unless otherwise specified.

EXAMPLE I

The following liquid detergent composition was prepared by mixing the listed ingredients:

| | |
|---|---|
| Sodium coconut alkyl sulfate | 11.5% |
| Sodium coconut alkyl ethoxyethersulfate (3 moles ethylene oxide/mole alkyl sulfate) | 14.0 |
| Coconut monoethanol amide | 5.0 |
| Monoethanolamine | 3.0 |
| $Na_2SO_3$ | 12.5 |
| Sodium nitrilotriacetate | 5.0 |
| Potassium sulfosuccinate | 2.6 |
| Bentonite L Clay | 2.5 |
| Ethanol | 9.5 |
| $K_4P_2O_7$ | 1.0 |
| $Na_2CO_3$ | 0.1 |
| Water & Miscellaneous | 33.3 |

The resultant composition was a stable suspension and provided a pH of 9.7 in a 0.4% water solution. Glass test strips carrying baked-on (400° F., 30 minutes) egg and macaroni and cheese soils, were soaked in 0.4% water solutions of the detergent composition at 115° F. for 15 minutes. The effort required to remove the soils after the soaking step was measured using a "Gardner Straight Line Washability and Abrasion Machine". The first ten strokes of the machine were made with a one-pound weight mounted over a holder with a sponge saturated with a 0.4% water solution of the composition. The next ten strokes were made with a three-pound weight over the sponge and the final ten strokes were made with a six-pound weight. The percentage of soil removed after each ten stroke cycle was recorded.

The detergent composition of Example I provided a 40-50% soil removal after 10 strokes, 60–70% soil removal after 20 strokes and 70–80% soil removal after 30 strokes. A comparable composition containing no monoethanolamine or sodium sulfite and having a pH of about 7 in a 0.4% water solution provided less than 10% soil removal after 30 strokes.

A composition is prepared in which the 3.0% monoethanolamine and 7% of the water is replaced by 10.0% urea and sufficient NaOH replaces water to provide a pH above 9.5 in 0.4% water solution. Comparable cleaning results are obtained. Comparable cleaning results are also obtained when sodium thiosulfate or sodium metabisulfite replace sodium sulfite.

EXAMPLE II

The following liquid detergent compositions within the scope of the present invention are prepared:

| | A | B | C | D | E | F | |
|---|---|---|---|---|---|---|---|
| Sodium $C_{12-15}$ alkyl sulfate | 12 | 10 | — | 2 | — | 14 | (Mg)* |
| Ammonium$_{12-15}$ alkyl ethoxyethersulfate (3 moles ethylene oxide/mole alkyl sulfate) | 15 | 15 | 15 | 15 | — | 12 | (Mg)* |
| Sodium $C_{14-16}$ parrafin sulfonate | — | — | 15 | — | — | — | |
| Sodium $C_{11-13}$ alkylbenzene sulfonate | — | — | — | — | 20 | — | |
| Coconut monoethanol amide | — | 5 | 7 | 3 | 5 | 7 | |
| Coconut ammonia amide | 6 | — | — | 3 | — | — | |
| $Na_2SO_3$ | — | 6 | 12 | 6 | — | 12 | |
| $Na_2S_2O_3$ | 12 | — | — | — | 6 | — | |
| $Na_2S_2O_5$ | — | 6 | — | 6 | — | — | |
| $K_4P_2O_7$ | 10 | — | — | 5 | — | — | |
| Sodium nitrilotriacetate | — | — | 6 | 4 | — | — | |
| Monoethanolamine | — | — | 3 | — | 4 | 5 | |
| Triethanolamine | 4 | — | — | — | — | — | |
| Urea | — | 10 | — | — | 4 | — | |
| Water and miscellaneous | | | | Remainder | | | |

*Magnesium alkyl sulfate and magnesium alkyl ethoxyether sulfate

Compositions A, B, C, D, E and F all provide improved protein and carbohydrate soil cleaning relative to compositions not containing both a reducing agent and a nitrogen-containing protein denaturant. The compositions all contain from 20% to 88.5% water and provide a pH of at least 9.5 in a 0.4% solution in water at 20° C.

What is claimed is:

1. A liquid detergent composition consisting essentially of:

(a) from about 15% to about 50% of an anionic surfactant selected from the water-soluble salts of organic sulfuric reaction products having in their molecular structure an alkyl radical containing from about 8 to about 22 carbon atoms and a radical selected from the group consisting of sulfonic acid, sulfuric acid ester radicals and mixtures thereof (b) from about 2.5% to about 10% of an amide of a fatty acid having the general formula $$R_1—CO—N(H)_m(R_2OH)_{2-m}$$

wherein $R_1$ is an aliphatic hydrocarbon radical having from about 7 to about 21 carbon atoms, $R_2$ is an aliphatic hydrocarbon radical having from 1 to 3 carbon atoms and m is zero, 1 or 2, (c) from about 2% to about 25% of a reducing agent selected from the group consisting of water-soluble salts of sulfites, bisulfites, thiosulfates, metabisulfites, salts of phosphorus and hypophosphorous acids, salts of hydrazine and hydroxylamine, stannites and mixtures thereof, (d) from about 2% to about 20% of a protein denaturant selected from the group consisting of urea, guanidine and its salts, thiourea, biuret, thiobiuret, ammonia, monoethanolamines, triethanolamine, and mixtures thereof, and (e) from about 20% to about 88.5% water, said detergent composition providing a pH of at least 9.5 in a 0.4% solution in water at 20° C.

2. The detergent composition of claim 1 wherein the amide comprises a monoethanol amide of $C_{10-16}$ fatty acids.

3. The detergent composition of claim 2 wherein the reducing agent comprises a material selected from the group consisting of alkali metal, alkaline earth metal, ammonium or substitutive ammonium salts of sulfites, bisulfites, thiosulfates, metabisulfites and mixtures thereof.

4. The detergent composition of claim 3 wherein the protein denaturant comprises a material selected from the group consisting of urea, ammonia, monoethanolamine and mixtures thereof.

5. The detergent compositions of claims 1, 2, 3 or 4 wherein the anionic surfactant comprises from about 20% to about 35% by weight of the composition and is selected from the group consisting of alkyl sulfates, alkyl ethoxyethersulfates, alkylbenzene sulfonates, paraffin sulfonates, olefin sulfonates and mixtures thereof.

6. The detergent composition of claims 1, 2, 3 or 4 wherein the anionic surfactant comprises from about 20% to about 35% by weight, the reducing agent comprises from about 5% to about 15% by weight, the protein denaturant comprises from about 3% to about 10% by weight, water comprises from about 25% to about 60% by weight and the pH of a 0.4% water solution of the composition is from about 9.7 to about 10.5 measured at 20° C.

7. The detergent composition of claims 1, 2, 3 or 4 which additionally consists essentially of from about 5% to about 25% of a detergent builder material selected from the group consisting of water soluble salts of phosphates, pyrophosphates, polyphosphates, phosphonates, carbonates, polyhydroxysulfonates, silicates, polyacetates, carboxylates, polycarboxylates, succinates, and mixtures thereof.

* * * * *